US007201302B2

(12) United States Patent
Panasik et al.

(10) Patent No.: US 7,201,302 B2
(45) Date of Patent: Apr. 10, 2007

(54) DRIVER BLADE WITH AUXILIARY COMBUSTION CHAMBER FOR COMBUSTION POWERED FASTENER-DRIVING TOOL

(75) Inventors: Cheryl L. Panasik, Elburn, IL (US); Kevin M. Tucker, Chicago, IL (US); Norbert K. Kolodziej, Park Ridge, IL (US); Yongping Gong, Glenview, IL (US); Robert B. Fischer, Roselle, IL (US)

(73) Assignee: Illinois Tool Works Inc., Glenview, IL (US)

( * ) Notice: Subject to any disclaimer, the term of this patent is extended or adjusted under 35 U.S.C. 154(b) by 28 days.

(21) Appl. No.: 10/931,631

(22) Filed: Sep. 1, 2004

(65) Prior Publication Data

US 2006/0043140 A1 Mar. 2, 2006

(51) Int. Cl.
*B25C 1/08* (2006.01)

(52) U.S. Cl. ..... 227/10; 227/9; 227/130; 173/206

(58) Field of Classification Search ..... 227/10, 227/9, 11; 173/206
See application file for complete search history.

(56) References Cited

U.S. PATENT DOCUMENTS 2,765,776 A * 10/1956 Pyk ..... 173/102
3,615,049 A 10/1971 Obergfell et al.
4,070,948 A * 1/1978 Tkach et al. ..... 91/234
4,530,445 A * 7/1985 Decker ..... 221/198
5,234,061 A * 8/1993 Hesse ..... 175/19
5,398,772 A * 3/1995 Edlund ..... 173/206
5,558,264 A 9/1996 Weinstein
5,860,580 A * 1/1999 Velan et al. ..... 227/10
6,059,162 A * 5/2000 Popovich et al. ..... 227/10
6,085,958 A * 7/2000 Kersten ..... 227/10
6,102,270 A 8/2000 Robinson
6,109,165 A 8/2000 Velan et al.
6,145,724 A 11/2000 Shkolnikov et al.
6,155,472 A 12/2000 Deziel
6,161,745 A * 12/2000 Grazioli et al. ..... 227/10
6,715,655 B1 * 4/2004 Taylor et al. ..... 227/8
6,719,182 B2 * 4/2004 Schalbetter et al. ..... 227/10
2003/0034377 A1 2/2003 Porth et al.

FOREIGN PATENT DOCUMENTS

EP 0 560 049 9/1993

OTHER PUBLICATIONS

U.S. Appl. No. 10/794,223, filed Mar. 5, 2004, Smolinski et al.

* cited by examiner

*Primary Examiner*—Scott A. Smith
*Assistant Examiner*—Gloria R. Weeks
(74) *Attorney, Agent, or Firm*—Greer, Burns & Crain, Ltd.; Lisa M. Soltis; Mark W. Croll

(57) ABSTRACT

A driver blade for use in a combustion-powered fastener-driving tool includes an elongate tubular body having a combustion end and a driving end, the combustion end being configured for attachment to a piston, and the driving end having a substantially solid cross-section. The tubular body is in fluid communication with a tool combustion chamber.

11 Claims, 2 Drawing Sheets

DRIVER BLADE WITH AUXILIARY COMBUSTION CHAMBER FOR COMBUSTION POWERED FASTENER-DRIVING TOOL

BACKGROUND

The present invention relates generally to fastener-driving tools used to drive fasteners into workpieces, and specifically to combustion-powered fastener-driving tools, also referred to as combustion tools.

Combustion-powered tools are known in the art, and one type of such tools, also known as IMPULSE® brand tools for use in driving fasteners into workpieces, is described in commonly assigned patents to Nikolich U.S. Pat. Re. No. 32,452, and U.S. Pat. Nos. 4,522,162; 4,483,473; 4,483,474; 4,403,722; 5,197,646; 5,263,439 and 6,145,724, all of which are incorporated by reference herein. Similar combustion-powered nail and staple driving tools are available commercially from ITW-Paslode of Vernon Hills, Ill. under the IMPULSE®[ ] and PASLODE® brands.

Such tools incorporate a tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to. Such ancillary processes include: inserting the fuel into the combustion chamber; mixing the fuel and air within the chamber; and removing, or scavenging, combustion by-products. The engine includes a reciprocating piston with an elongated, rigid driver blade disposed within a single cylinder body.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original, or pre-firing position, through differential gas pressures within the cylinder. Fasteners are fed magazine-style into the nosepiece, where they are held in a properly positioned orientation for receiving the impact of the driver blade.

Conventional combustion fastener driving tools employ straight magazines holding approximately 30 fasteners each. In some operational applications, particularly commercial construction projects, there is a need for a tool which is capable of driving a greater number of fasteners in a shorter period of time. The use of coil magazines with greater fastener capacities is common in electrically or pneumatically powered fastener driving tools, but for various reasons, such magazines have not become acceptable with combustion tools. Reasons for the undesirability of such high capacity magazines in these tools include the additional weight of the fasteners causing premature operator fatigue, and the additional energy required to operate the coil magazine fastener advance has not proved reliable.

Aside from the size of the magazine of conventional combustion tools, the weight, balance and overall ergonomics of conventional tools have not been suitable for high volume commercial construction applications, among others. In addition, when more rapid firing rates are contemplated for such tools, care must be taken to ensure that at the conclusion of each firing cycle, the piston returns to its prefiring position before the next firing cycle begins. Failure of the piston to properly return has been known to cause tool jams and other operational difficulties.

Thus, there is a need for a combustion-powered fastener-driving tool which is capable of operating reliably with high capacity magazines, including but not limited to coil magazines. There is also a need for a combustion-powered fastener-driving tool which is designed for driving fasteners from such a magazine at a relatively high rate.

BRIEF SUMMARY

The above-listed needs are met or exceeded by the present driver blade, preferably provided associated with a piston. The driver blade is generally hollow, which reduces weight, thus reducing overall tool weight and also requiring less energy to return to the prefiring position. In addition, the substantially hollow configuration increases the volume of the combustion chamber, thus increasing the firing power of the tool. A lower end of the driver blade is provided with a solid cross-section for facilitating the fastener driving operation.

More specifically, a driver blade for use in a combustion-powered fastener-driving tool includes an elongate tubular body having a combustion end and a driving end, the combustion end being configured for attachment to a piston, and the driving end having a substantially solid cross-section.

In another embodiment, a combined piston and driver blade for a combustion powered fastener-driving tool includes a piston head having an outer periphery configured for slidably engaging a cylinder and defining a central aperture, an elongate driver blade tubular body having a combustion end and a driving end, the combustion end being configured for attachment to the piston, and the driving end having a substantially solid cross-section.

In still another embodiment, a combustion chamber for a fastener-driving tool includes a cylinder head, a valve sleeve, a piston defining a central aperture, a driver blade secured to the piston and having a tubular body defining a closed chamber in fluid communication with the piston.

DETAILED DESCRIPTION

Figure 1:
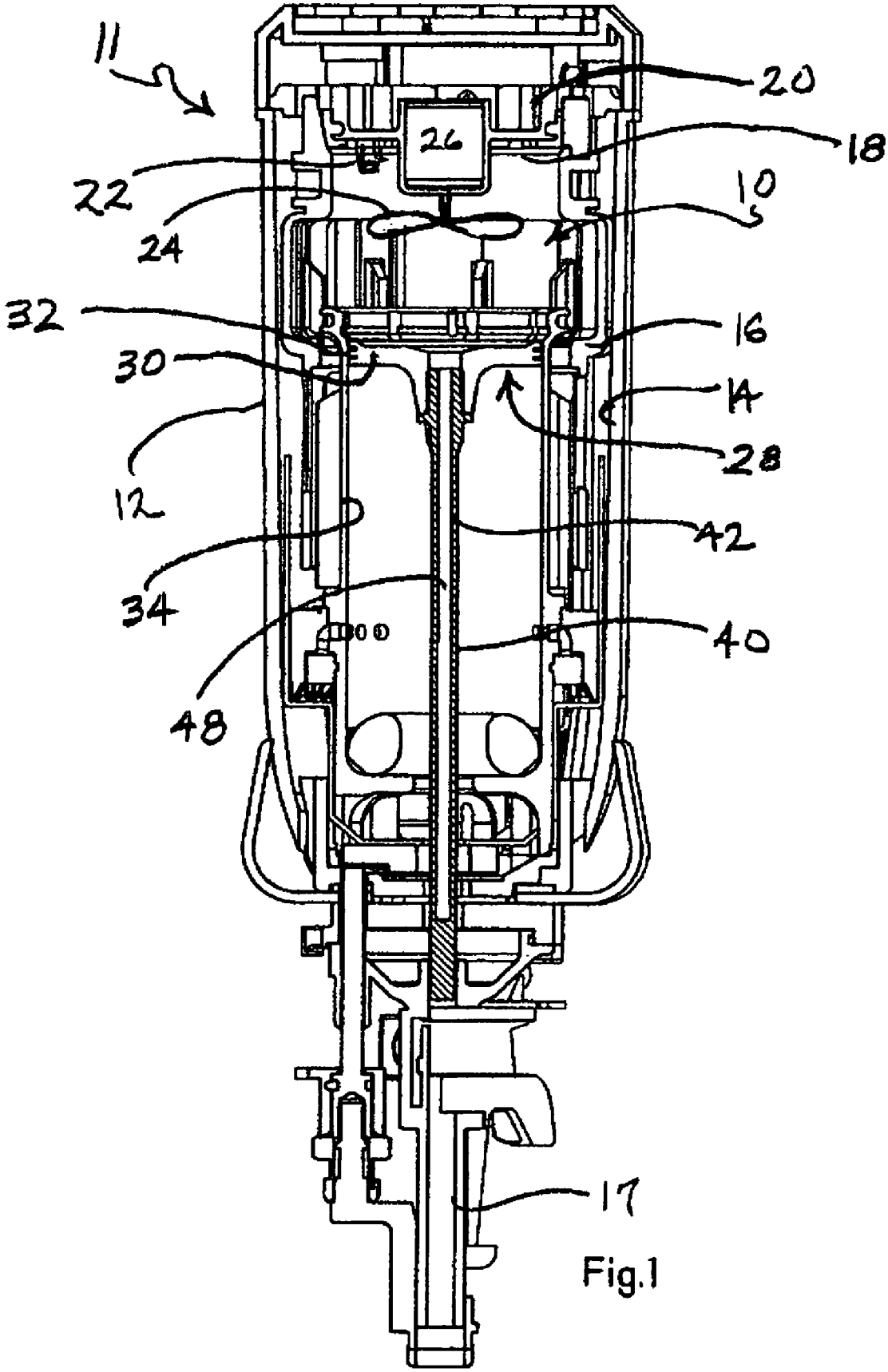
FIG. 1 is a fragmentary front vertical section of a combustion-powered fastener-driving tool suitable for incorporating the present driver blade.

Referring now to FIG. 1, a combustion chamber for a combustion-powered fastener-driving tool incorporating the present invention is generally designated 10. The present combustion chamber 10 and associated components are suitable for use in any type of combustion-powered fastener-driving tool, generally designated 11, including but not limited to the general type described in detail in the patents listed above and incorporated by reference in the present application. A housing 12 of the tool 11 encloses the combustion chamber 10 within a housing main chamber 14.

The combustion chamber 10 is defined on the sides by a generally cylindrical reciprocating valve sleeve 16, which as is known in the art, reciprocates between an open or exhaust position (shown here) when the tool is at rest or between firings, and a closed or combustion position just prior to and during the firing portion of the tool cycle. The closed position is achieved by pressing the tool against a workpiece, which depresses a biased nosepiece workpiece contact element 17. At an upper end 18, the combustion chamber 10 is defined by a cylinder head 20. While other configurations are contemplated, the cylinder head 20 is provided with a spark plug 22 and a fan 24 which depends into the combustion chamber. A motor 26 powers the fan 24.

Figure 2:
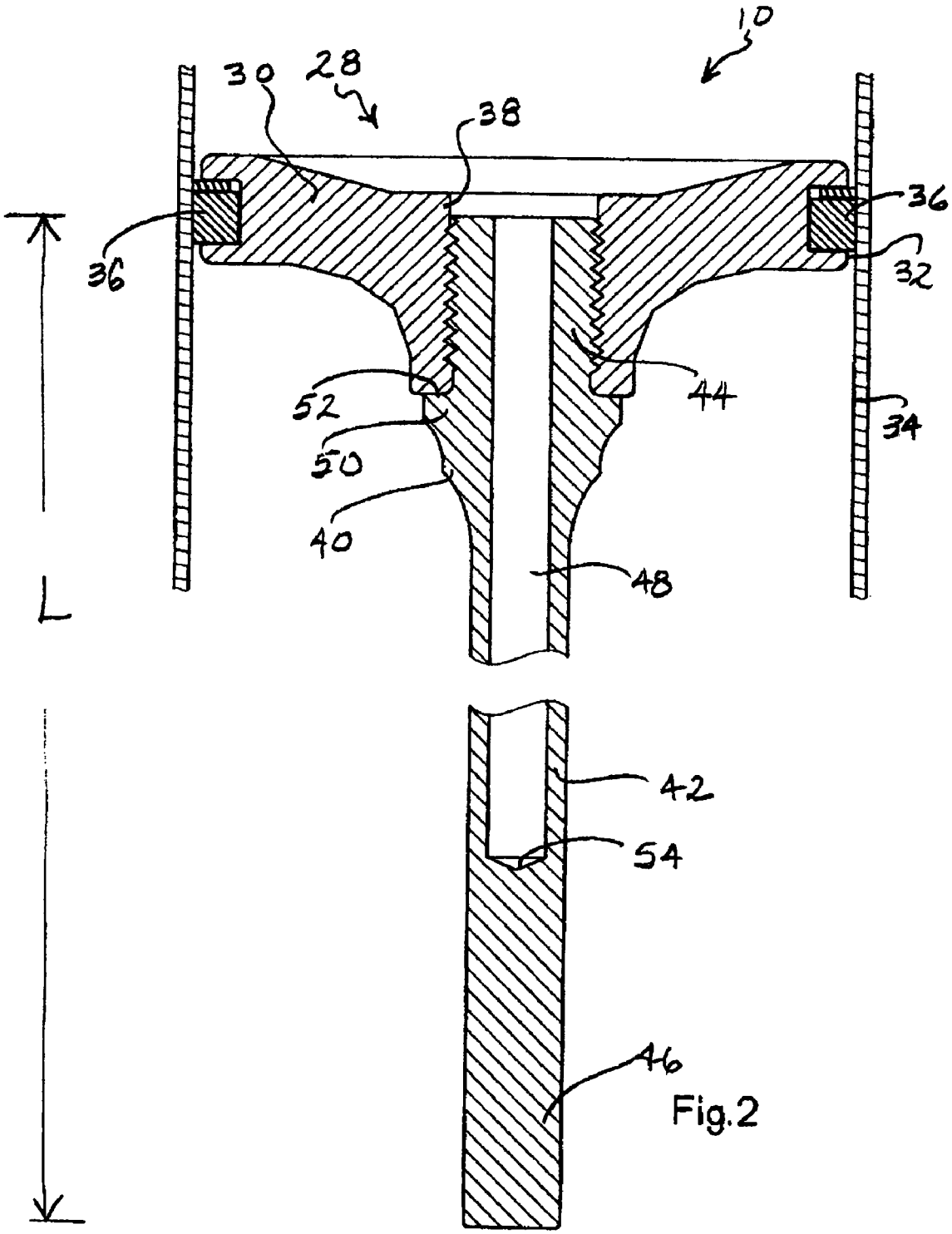
FIG. 2 is a fragmentary vertical section of the present piston and driver blade assembly.

Referring now to FIGS. 1 and 2, a lower end of the combustion chamber 10 is defined by a piston, generally 28, in an uppermost or prefiring position. The piston 28 has a body or head 30 which is circular when viewed from above and has an outer peripheral edge 32 configured for slidably engaging a cylinder 34. As is known in the art, piston rings 36 (various configurations of which are depicted) are typically provided on the piston head 30 to maintain an operational seal and reduce wear on the sliding components. The piston head 30 defines a central aperture 38 which is preferably threaded or provided with some other fastening formation. It will be seen that the central aperture 38 defines a portion of the lower end of the combustion chamber 10.

A driver blade 40 is secured to the piston 28 and reciprocates with the piston in the cylinder 34 for driving fasteners into workpieces as is well known in the art. While conventional driver blades are solid to maximize impact force and maintain structural integrity after repeated firing cycles, an important feature of the present driver blade 40 is that it is substantially hollow. It has been found that in some applications, strength is not sacrificed, but a lighter weight component is obtained. Also, by being substantially hollow, the driver blade 40 increases the volume of the combustion chamber 10. This increased volume provides more fastener driving power and a more rapid, yet reliable return of the driver blade 40 to the prefiring position.

More specifically, the driver blade 40 has an elongate, generally tubular body 42 having a combustion end 44 and a driving end 46 opposite the combustion end. For best results, the combustion end 44 is open to ambient. The body 42 has a hollow interior and defines a driver blade chamber 48 which, through the combustion end 44, is in fluid communication with the central aperture 38 of the piston 28 and ultimately, the combustion chamber 10. As such, the driver blade chamber 48 becomes an auxiliary combustion chamber.

The combustion end 44 is configured for attachment to the piston 28, and in the preferred embodiment is externally threaded to threadably engage the threaded central aperture 38. Other known fastening technologies are contemplated, including welding, chemical adhesives, spring locks, bayonet lugs and grooves and the like. For additional strength and positive engagement with the piston 28, the driver blade 40 is provided with a radially thickened portion 50 near the combustion end 44 defining a shoulder 52. Opposite the combustion end 44, a closed end 54 of the driver blade chamber 48 is preferably conically shaped (seen in FIG. 2) for facilitated fabrication and/or distribution of combustion forces.

For achieving a positive driving action when contacting fasteners, the driving end 46 has a substantially solid cross-section. Beneficial results have been found when the solid driving end 46 takes up approximately 15% of the total length of the body 42, and the driver blade chamber 48 represents the remainder of the total length L of the body, or approximately 85%. Thus, in one particular exemplary embodiment, the total length of the body 42 is 7.5 inches, and the driver blade chamber 48 is 6.38 inches. The above-described percentages and lengths are exemplary only, and may vary to suit the application, power level of the tool and type of fastener being driven, among other parameters known to skilled practitioners.

While a particular embodiment of the present driver blade with auxiliary combustion chamber for a combustion-powered fastener-driving tool has been described herein, it will be appreciated by those skilled in the art that changes and modifications may be made thereto without departing from the invention in its broader aspects and as set forth in the following claims.

The invention claimed is:

1. A driver blade in a combustion-powered fastener-driving tool, having a combustion chamber, the driver blade comprising:

an elongate tubular body having a length, a combustion end, a driving end and defining a driver blade chamber, said length being defined between a tip of said driving end and said combustion end;

said combustion end being open to ambient air in communication with said combustion chamber, said combustion end being threaded and being configured for attachment to a piston;

upon said attachment to said piston, said driving end being a leading end during the forward, driving motion of said tubular body, said driving end having a solid cross-section, said driving blade chamber extending over half said length of said driver blade and forming an auxilary combustion chamber.

2. The driver blade of claim 1 wherein said driver blade chamber has a closed lower end.

3. The driver blade of claim 1 wherein said driver blade chamber extends approximately 85% of said length of said tubular body.

4. The driver blade of claim 1 wherein said combustion end has a radially thickened portion for engaging the piston.

5. A combined piston and driver blade in a combustion powered fastener-driving tool, comprising:

a piston head having an outer periphery configured for slidably engaging a cylinder during a driving motion of said piston head, and defining a central aperture;

an elongate driver blade tubular body having a combustion end-, a driving end having a tip, and a closed end driver blade chamber in communication with said combustion end, wherein said closed end of said chamber is closer to the tip than to the piston;

said combustion end being attachable to said piston so that upon attachment to said piston, said driver blade chamber extends between said piston and said driver blade;

said driving end being a leading end during the driving motion of said piston and driver blade down the cyclinder for impacting a fastener, said driving end having a solid cross-section; and said driver blade chamber extends more than half the length of said driver blade where the length is defined between a tip of said driving end and said piston.

6. The combination of claim 5 wherein said aperture is threaded and said combustion end is threaded to engage said aperture such that upon said engagement, said driver blade chamber maintains communication with said aperture.

7. A combustion chamber in a fastener-driving tool, the combustion chamber comprising:

a cylinder head;

a valve sleeve;

a piston defining a central aperture; and a driver blade secured to said piston and having a tapered portion and an elongated portion of substantially constant diameter extending from said tapered portion away from said piston, said elongate portion extending towards a forward, driving end of said driver blade, said tapered portion being hollow, and said eolngate portion having a hollow body in fluid communication with said central aperture and defining a closed end driver blade chamber in fluid communication with said piston.

8. The combustion chamber of claim 7 wherein said tubular body is defined at a lower end by a driving end having a solid cross-section.

9. The combustion chamber of claim 7 wherein said tubular body forms an auxiliary combustion chamber in fluid communication with said combustion chamber.

10. The combustion chamber of claim 7 wherein said driver blade chamber extends more than half the length of said driver blade where the length is defined between a tip of said driver blade at said forward, driving end and said piston.

11. A driver blade in a combustion-powered fastener-driving tool having a combustion chamber, the driver blade comprising:

an elongate tubular body having a length, a combustion end, a driving end and defining a driver blade chamber, said length being defined between a tip of said driving end and said combustion end;

said combustion end being open to ambient air in communication with said combustion chamber, and being configured for attachment to a piston;

said driving end being the leading end during the forward, driving motion of said tubular body, said driving end having a solid cross-section, said driver blade chamber extending over half said length of said driver blade and forming an auxiliary combustion chamber, wherein said tubular body has a hollow cross-section at said driver blade chamber, wherein said hollow cross-section provides increased volume for said chamber, and increased volume provides more fastener driving power.

* * * * *